United States Patent [19]

Hetke et al.

[11] 4,010,791

[45] Mar. 8, 1977

[54] METHOD FOR CAVITYLESS CASTING EMPLOYING A DUAL LAYER PATTERN COATING

[75] Inventors: Adolf Hetke, Livonia; Kip M. Bonds, Union Lake, both of Mich.

[73] Assignee: Ford Motor Company, Dearborn, Mich.

[22] Filed: Aug. 29, 1975

[21] Appl. No.: 608,959

[52] U.S. Cl. ..... 164/34

[51] Int. Cl.[2] ..... B22C 9/02

[58] Field of Search ..... 164/34, 246

[56] References Cited

UNITED STATES PATENTS 3,426,834 2/1969 Jacobs et al. ..... 164/34 X

*Primary Examiner*—Richard B. Lazarus

*Attorney, Agent, or Firm*—Joseph W. Malleck; Keith L. Zerschling

[57] ABSTRACT

A pattern destructible on contact with a molten metal charge is given a composite coating consisting of a highly tacky viscous adhesive substantially devoid of solids and single particle thickness layer collection of ultra-fine refractory particles (carbon facing sand) aligned on the surface of said adhesive. The adhesive volatilizes on contact with the casting charge while the refractory particles remain unaffected. An ultra-smooth cast surface is produced without macro crevices inherent in the surface of a destructible pattern and the mold sand is reusable without contamination by a high portion of burned sand.

7 Claims, 1 Drawing Figure

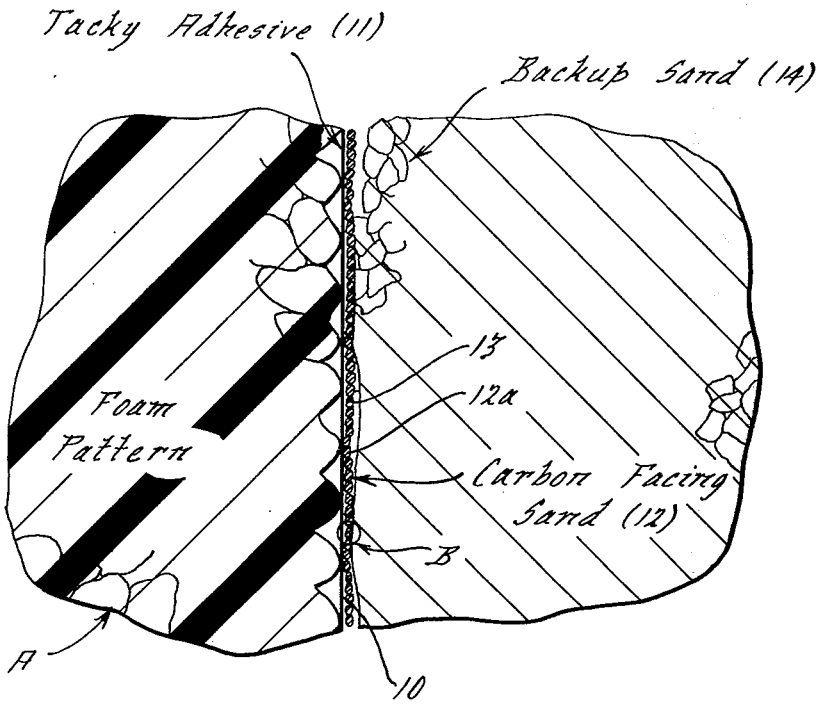
Tacky Adhesive (11)
Backup Sand (14)
13
12a
Foam Pattern
Carbon Facing Sand (12)
B
A
10

METHOD FOR CAVITYLESS CASTING EMPLOYING A DUAL LAYER PATTERN COATING

BACKGROUND OF THE INVENTION

Considerable attention has been devoted to the "cavityless technique" of casting. This technique employs a pattern formed from a material that is substantially completely volatile or combustible upon contact with molten metal. Accordingly, the mold body, typically of sand, is arranged with a pouring opening and a vent opening, each communicating with the embedded pattern; upon pouring the molten casting charge into the pouring opening, contact between the entering molten metal with the pattern will cause a rapid volatilization or decomposition of the pattern material so that it is completely destroyed, leaving behind a cavity in a mold body which is in turn filled by the casting charge.

Foamed, thermoplastic resinous materials, such as polystyrene foam, are ideally suited to the production of these fugitive patterns. They possess the necessary strength to remain dimensionally stable during embedment of the pattern in the sand mold body and the actual weight of the material is dramatically small. This, coupled with the volatility of the resinous foam, makes for a rapid and complete burn out of the pattern upon the pouring of the casting charge.

The pattern can be fabricated either from a solid block of such foam resin or by expanding resinous beads to the shape of a pattern die. Cutting blocks to shape results in certain rough portions on the pattern surface. If the pattern is molded out of polystyrene beads through a conventional process of steaming and expanding the beads to form a solid mass, the beads tend to define a porous surface where the curved surfaces of separate beads meet. The full explanation for the formation of such porosity is not fully understood, although it is believed that the pressure of steam used to expand the beads, applies a uniform outward force with respect to each bead. But the outer die, in which the beads are expanded offers a continuous resistance surface along all of the beads. The beads are restrained at point contact with respect to each individual bead; the resistance surface does not act uniformly with respect to each bead. As a result, small depressions at the juncture between adjacent beads is produced.

It has been suggested by the prior art that such pattern surface be smoothed by the application of a hot element, such as an iron; this has proven to be of little value since it is impossible to maintain an accurate dimension for the pattern by the pressing technique. It is also been proposed by the prior art to sue wax-like coatings which are meltable along with the fugutive pattern upon contact by the molten metal. This also has proven to be of little value because the wax-like coatings are difficult to maintain in an accurately smooth condition prior to casting and volatilization of the wax may occur in advance of volatilization of the pattern thereby retaining the problem as previously encountered.

In the earlier tests to solve the problem of a rough or imperfect surface of a casting formed by a foam pattern, the use of permeable washes were used; they were formed of a slurry of ceramic material consisting typically of pulverulent refractory material, an aqueous dispersing medium and a small amount of binding agent. Such slurries or washes did not prove entirely satisfactory since their purpose was to resist the molten metal and stay solid while the pattern was evaporated. This still does not produce an answer to the problem requiring an ultra-smooth surface since the refractory material, which remained after the pattern was volatilized, possessed the porous-type imprinted surface of the pattern.

Certain critical applications require that castings formed by this technique have an ultra-smooth surface devoid of any defect or undulations. For example, in the making of dynamically loaded elements, such as crankshafts or disc brake calibers, the presence of any slight crevice or pore will promote a site for fatigue fracture to start and will eventually reduce the fatigue life of said element.

Moreover, regardless of how smooth the pattern surface may eventually be made, refractory materials defining the mold cavity will have a particle size which imprints microscopic or small defect sites onto the casting surface since such casting must conform to the sand particle restraint.

Some mechanism must be found to provide an ultra-smooth surface for castings which are made by the cavityless method utilizing foamed fugitive patterns and sand and/or other molding media molds.

SUMMARY OF THE INVENTION

The primary object of this invention is to provide a destructible or fugitive pattern of foamed, resinous thermal plastic material, the use of which in a cavityless casting method will result in castings of unusually smooth surfaces.

Another object of this invention is to provide an improved method for making castings by the cavityless method, which method eliminates break down of the sand material constituting the mold for said technique upon contact by the molten metal, such break down being caused as a result of burning of said sand particles at the immediate contact with said molten metal.

Particular features pursuant to the above objects is the use of a composite coating on said foam pattern, the first portion of said coating consisting of a highly tacky, highly viscous adhesive substantially devoid of solid or refractory particles, the second portion of said coating consisting of refractory particles having a typical size in the range of 100–140 AFS and which particles are held in place by contact with said adhesive.

SUMMARY OF THE DRAWING

FIG. 1 is a highly enlarged schematic illustration of the macroscopic character of a portion each of the foam pattern, composite coating, and mold material consisting essentially of back-up sand and/or other molding medium.

DETAILED DESCRIPTION

According to the present invention, a destructible pattern A of foam thermoplastic resinous material is given a smooth surface 10 by the application of a composite coating B. One portion of the coating consists of a fugitive portion 11 which vaporizes upon contact with the molten material and the other portion 12 of the coating is comprised of extremely fine particles not effected by contact of the molten metal and therefore are not fugitive. The portions of the coating cooperate to align the small particles 12*a* of the nonfugitive portion into an extremely smooth flat arrangement.

The fugitive portion 11 of the coating is preferably comprised of a tacky adhesive, preferably an adhesive commonly referred to as synthemul, having a typical chemical composition consisting essentially of: acrylic resin having approximately 65% non-volatiles in solution with 100% normal propyl alcohol. Other adhesives can be employed provided they possess the following characteristics: a tackiness characterized by viscosity of 10,000 cps, an adhesive quality which will not chemically attack fugitive foam materials (such as polystyrenes), the adhesive is sprayable or capable of being deposited in an ultrathin coating no greater than 0.002 inches thick, and the adhesive will flow to fill the pores or crevices of the foam material. In addition, the adhesive must be characterized by low gas and solid content. The gas content must be extremely low. When the adhesive is pryolized upon contact by the molten metal, it is important that there be no excessive generation of gases which migrate through the interstices of the mold material. Such interstices or channels must be utilized primarily by the vaporized foam pattern material for escape; if excessive or additional gas is generated by the adhesive material, the ability of the porous molten material to release such gas would be burdened. The low solid contact requires that the adhesive be substantially devoid of any refractory materials. The ability to form the smooth surface is dependent upon this characteristic.

The nonfugitive portion 12 of the coating is preferably comprised of a carbon facing sand having a particle size in the range of a typical 100–140 AFS. Carbon facing sand is a by-product of petroleum manufacturing; it will not break down upon contact by molten metal (temperatures in excess of 2100° F), such as conventional sand. Other equivalent nonfugitive materials should possess the characteristics: do not break down at the temperatures of the molten metal upon contact therewith and thus become equivalent to a dust, and possess an extremely uniform fine particle size so that the particles can be aligned to form an ultra-smooth flat interface. It is important that the carbon facing sand or equivalent nonfugitive material of a fine nature be applied in ultra-low quantities, that is that the coating of the facing sand should be no greater than two particle diameters thickness. This insures that the concentration of facing sand will not be excessive and thereby cause problems upon re-use of the molding sand for subsequent molding operations.

The material from which the mold cavity 13 is formed is preferably unbonded sand 14 having a minimum particle size range of 20–40 AFS. Such molding material is identified herein as backup sand; it will impart microcrevices or pores if molten material is solidified directly in contact therewith. The unbonded sand can also be broken down slightly by a phenomenon called burn-in upon contact with the molten metal. This is avoided by the interposition of the carbon facing sand in a particularly unique aligned disposition as taught herein.

We claim as our invention:

1. In a process for casting metals by utilization of a mold having embedded therein a destructible pattern of foam thermoplastic resinous material, said mold having refractory particles about said pattern to define a mold cavity and in turn to define a casting upon introduction of molten metal to said pattern and consequent destruction of the pattern, the surface of the resulting casting corresponding to the shape of the mold particles defining the cavity as well as the surface of the foam material, said process including the pouring of molten metal into said mold whereby the foam pattern is destroyed and displaced by metal, the improvement comprising:

depositing a dual layer coating on the surface of said pattern, the first and inner layer of said coating consisting essentially of a highly tacky viscous adhesive substantially devoid of solids or refractory particles, said adhesive filling the pores or crevices inherently defined in the outer surface of said foam pattern, the second and outer layer of said coating consisting essentially of a collection of dry refractory particles in the size range of 100–140 AFS, each of said particles being secured on said pattern by the adhesive quality of said first layer, only those particles of said second layer having a portion thereof in contact with said first layer being so secured, the particles of said second layer being unsecured with respect to each other and thereby constitute a permeable second layer aligned on the surface of said adhesive to present an ultrasmooth surface, said coating having the first layer thereof volatilized along with said pattern upon pouring of molten metal into said mold while the second layer of said coating remains unaffected and thus functions to define the outer surfae of the resultant casting.

2. The improvement as in claim 1, in which said mold is comprised of backup sand having a particle size typically in the range of 20–40 AFS.

3. The improvement as in claim 1, in which said first layer is comprised of an adhesive applied in a thickness range no greater than 0.002 inches.

4. The improvement as in claim 1, in which said adhesive is particularly characterized by a low gas content upon being volatilized.

5. The improvement as in claim 1, in which said layer consists essentially of carbon facing sand or other sand effective not to break down upon contact with molten metal charged into said mold.

6. The improvement as in claim 1, in which said second layer has a thickness no greater than two particles dimensions of said refractory particles.

7. The improvement in claim 1, in which said second layer is formed by dusting the particles of said second layer into said first layer whereby said second layer is constituted substantially of particles aligned side by side each having some portion in contact with said first layer, said second layer having a thickness substantially one particle in dimension but no greater than two particle dimensions.

* * * * *